US005561438A

United States Patent [19]

Nakazawa et al.

[11] Patent Number: 5,561,438

[45] Date of Patent: Oct. 1, 1996

[54] FERRITE ANTENNA

[75] Inventors: Toshihiko Nakazawa; Akihiro Fukuzawa, both of Suwa, Japan

[73] Assignee: Seiko Epson Corporation, Tokyo-to, Japan

[21] Appl. No.: 341,859

[22] Filed: Nov. 18, 1994

Related U.S. Application Data

[63] Continuation of Ser. No. 974,547, Nov. 12, 1992, abandoned.

[30] Foreign Application Priority Data

Nov. 13, 1991 [JP] Japan ..... 3-297420
Aug. 7, 1992 [JP] Japan ..... 4-211454

[51] Int. Cl.[6] ..... H01Q 1/00; H01Q 7/08

[52] U.S. Cl. ..... 343/787; 343/788

[58] Field of Search ..... 343/785, 787, 343/788, 895; 336/200, 205

[56] References Cited

U.S. PATENT DOCUMENTS

| | | | |
|---|---|---|---|
| 3,594,805 | 7/1979 | Chardin | 363/787 |
| 4,777,465 | 10/1988 | Meinel | 336/200 |
| 4,805,232 | 2/1989 | Ma | 363/788 |
| 4,814,782 | 3/1989 | Chai | 363/787 |
| 4,839,659 | 6/1989 | Stern et al. | 363/787 |
| 5,014,079 | 5/1991 | King | 343/788 |
| 5,164,737 | 11/1992 | Murray et al. | 363/788 |

FOREIGN PATENT DOCUMENTS

| | | | |
|---|---|---|---|
| 0137206 | 8/1983 | Japan | 336/200 |
| 32613 | 2/1987 | Japan . | |
| 32614 | 2/1987 | Japan . | |

*Primary Examiner*—Donald T. Hajec
*Assistant Examiner*—Tan Ho
*Attorney, Agent, or Firm*—Harold T. Tsiang

[57] ABSTRACT

A ferrite antenna is disclosed. The antenna includes a board on which a ferrite component is mounted. The board includes a plurality of slots and a conductive pattern extending between two of the slots. First and second metal bands are wound around the ferrite component and inserted into the slots. The metal bands are coupled together by the conductive pattern to form a coil. Thus, the interval between adjacent bands can be more accurately set and the antenna can be more easily fabricated. In another embodiment, a metal band partially encloses the ferrite component and covers an open area between the ferrite component and one end of the metal band. The sensitivity of the antenna is thus increased beyond the upper limit of a regular ferrite antenna. In still another embodiment, conductive patterns are formed on the periphery of the board and coupled to the metal bands to improve the directional sensitivity of the antenna.

23 Claims, 7 Drawing Sheets

FERRITE ANTENNA

This is a continuation of application Ser. No. 07/974,547 filed Nov. 12, 1992, now abandoned.

BACKGROUND OF THE INVENTION

This invention generally relates to an antenna for communication equipment. More particularly, it relates to a ferrite antenna that includes a coil which can be more accurately wound around the ferrite component of the antenna and which has improved sensitivity.

FIG. 7 shows a prior art ferrite antenna that includes a square ferrite bar 1 and a metal band 10. Ferrite bar 1 is wound around with metal band 10 by hand. Metal band 10 is a single unit including several continuous windings which form a spiral shape. The metal band is mounted on a board (not shown) by soldering both ends of the metal band on the board.

However, the fabrication process of the prior art antenna described above is complicated since the ;metal band cannot be easily wound around the ferrite bar. Thus, the coil interval of the antenna, i.e., the interval between two adjacent windings, cannot be accurately set. This problem which reduces the productivity and causes; variations in the winding tolerance measurements, thus making the characteristics of the antenna unstable. Further, since the metal band is soldered on a base pattern on the board, the metal band and the board may be easily separated from each other due to a dropping or an impact because of the weight of the ferrite bar.

SUMMARY OF THE INVENTION

The present invention provides an antenna with stable characteristics and improved sensitivity as well as superior productivity.

The present invention includes four embodiments. According to one aspect of a first embodiment of the invention, the antenna has a board including a conductive pattern on its surface and a plurality of slots at preselected locations. The pattern has first and second ends extending between and diagonally coupling a slot from a first pair of slots and a slot from a second pair of slots.

According to another aspect of the first embodiment, a ferrite component is mounted on the board.

According to a further aspect of the first embodiment, a first conductive band is wound around the ferrite component and coupled to the board through the first pair of slots. The first band has one end coupled to the first end of the pattern to form a turn of a coil. A second conductive band is coupled to the board through the second pair of slots. The second band has one end coupled to the second end of the pattern to form a second turn of the coil. Additional conductive patterns and conductive bands may be added and arranged in a similar way.

A second embodiment of the invention is a variation of the first embodiment. According to one aspect of the second embodiment, the antenna has a board including a conductive pattern on its surface and a plurality of slots located along a side of the board. The pattern has first and second ends extending between and coupling together a slot from a first pair of slots and a slot from a second pair of slots.

According to another aspect of the second embodiment, a ferrite component is coupled to the board.

According to a further aspect of the second embodiment, a first conductive band is wound around the ferrite component and clamped to the board along the side through the first pair of slots. The first band has one end coupled to the first end of the pattern to form a turn of a coil. A second conductive band is clamped to the board along the side through the second pair of slots. The second band has one end coupled to the second end of the pattern to form a second turn of the coil.

Thus, the antenna of the invention can be more easily assembled by inserting terminals of the bands into the slots on the board and soldering them together. Therefore, the bands and the board cannot be easily separated from each other, preventing any displacement of the bands due to a dropping or an impact. Furthermore, the interval between adjacent bands can be more accurately set, resulting in more stable antenna characteristics.

A third embodiment of the invention increases the sensitivity of the antenna beyond the upper limit of that of a regular ferrite antenna. According to one aspect of a third embodiment of the invention, the ferrite antenna has a curved board including first and second arms as well as a plurality of slots.

According to another aspect of the third embodiment, a ferrite component is mounted on the first arm of the board.

According to a further aspect of the third embodiment, a first conductive band is coupled to the board through the slots, partially enclosing the ferrite component and an open area between the ferrite component and one end of the band. A second conductive band is wound around the ferrite component and coupled to the first band and the board through the slots. Additional bands may be added and arranged in a similar way.

According a still further aspect of the third embodiment, a pair of contact pins is coupled to the first and second bands respectively on the board for coupling the antenna to a timing circuit.

The antenna of the third embodiment includes two parts. The first part includes the ferrite component, the second band and a portion of the first band that closely covers the ferrite component. The second part includes the open area, a portion of the first band that covers the open area and the pair of contact pins. By adding the second part to the antenna, the sensitivity of the antenna is increased beyond the upper limit of a regular ferrite antenna using the same ferrite bar.

A fourth embodiment of the invention improves the directional sensitivity of the antenna. According to one aspect of the fourth embodiment, the antenna has a board including a first and second conductive patterns on its surface around the periphery of the board for coupling to a reception circuit at a first end of each pattern.

According to another aspect of the fourth embodiment, a ferrite component is mounted on the board.

According to a further aspect of the fourth embodiment, a first conductive band is wound around the ferrite component and coupled to the first and second patterns at a second end of each pattern. A second band is coupled between the first band and the second end of the second pattern. The first and second bands are coupled to the board through the slots. Additional conductive bands may be added and arranged in a similar way.

The antenna of the fourth embodiment includes a ferrite antenna and a loop antenna. The ferrite antenna includes the ferrite component and the first and second bands. The loop antenna includes the conductive patterns on the periphery of the board. By adding the loop antenna, the directional sensitivity of the antenna is improved.

The above and other features and advantages of the invention will become more apparent from the following description taken in conjunction with the accompanying drawings.

DESCRIPTION OF THE PREFERRED EMBODIMENTS

Figure 1A:
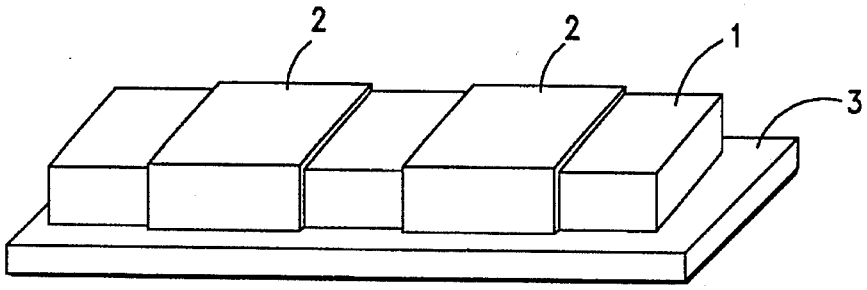
FIG. 1A illustrates a ferrite antenna according to a first embodiment of the invention.
Figure 1B:
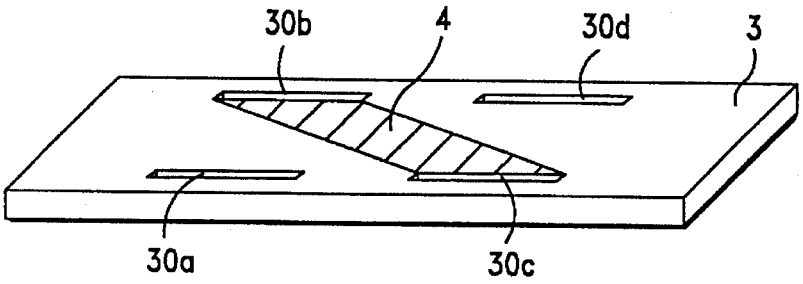
FIG. 1B shows the board in FIG. 1A.
Figure 1C:
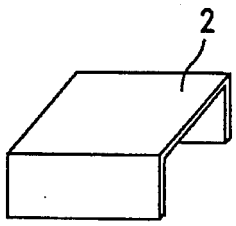
FIG. 1C shows the metal band in FIG. 1A.

FIGS. 1A–1C illustrate a first embodiment of the invention. FIG. 1A depicts a ferrite antenna according to the first embodiment. A ferrite component, such as a square ferrite bar 1, is mounted on a board 3 by an adhesive and is wound around with two conductive bands, such as metal bands 2. The ends of metal bands 2 are connected to board 3. A two-turn ferrite antenna is thus formed by aligning two metal bands 2 side by side around ferrite bar 1 and coupling metal bands 2 together on board 3 as the coil, as will be described in detail below.

FIG. 1B shows board 3 of FIG. 1A. A first pair of slots 30*a* and 30*b* and a second pair of slots 30*c* and 30*d* are located on board 3. The two slots in each pair are located on the two sides of the board opposite to each other for insertion by a respective metal band 2 for winding around ferrite bar 1. Metal bands 2 may be connected to board 3 by soldering the ends of the metal bands in the respective slots, for example. Metal bands 2 may also be connected to the respective slots by mechanical means. A conductive pattern 4 on board 3 diagonally connects slots 30*b* and 30*c* for coupling together the metal bands inserted in the slots and forming a part of the coil.

FIG. 1C depicts metal band 2 of FIG. 1A. Metal band 2 can be easily fabricated by bending a metal plate into a U-shaped metal band with a machine. Each metal band is equivalent to ¾ of a turn and forms one turn of a coil in conjunction with pattern 4 on board 3.

In a similar manner, a ferrite antenna with a multi-turn coil can be fabricated by aligning a plurality of metal bands side by side around a ferrite bar and coupling adjacent metal bands together by a plurality of conductive patterns on the board. By employing the metal bands of the invention, the coil interval of the ferrite antenna, i.e., the distance between two adjacent metal bands, can be more easily and accurately set. Thus, any variations in antenna characteristics caused by the manufacturing process can be minimized. Accordingly, a more stable method of manufacturing a ferrite antenna is provided by the invention. Where a narrow ferrite bar is used with large metal bands, the narrow ferrite bar can be mounted on the board by an adhesive and the metal bands are connected to the respective slots on the board across the ferrite bar. Alternatively, the narrow ferrite bar is placed and held in an insulation case mounted on the board and the metal bands are connected to the respective slots on the board across the insulation case.

Figure 2A:
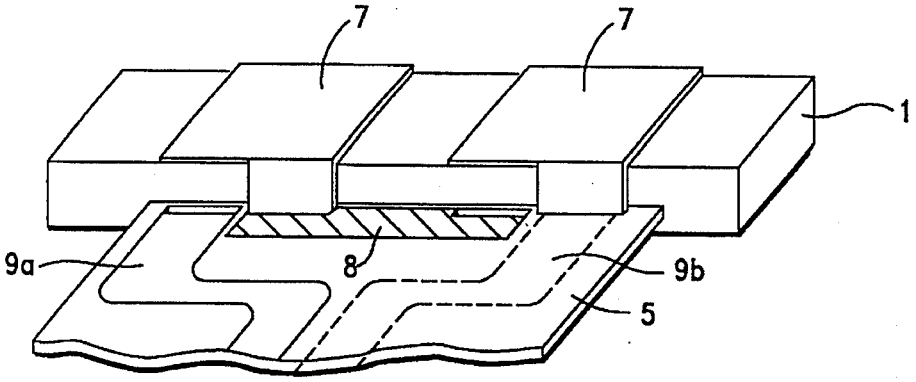
FIG. 2A illustrates a ferrite antenna according to a second embodiment of the invention.
Figure 2B:
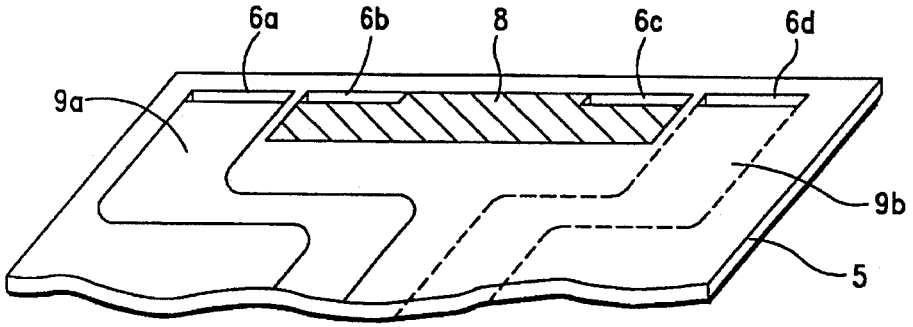
FIG. 2B shows the board in FIG. 2A.
Figure 2C:
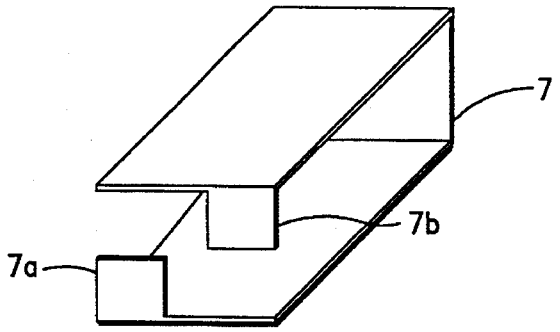
FIG. 2C shows the metal band in FIG. 2A.

FIGS. 2A–2C illustrate a second embodiment of the invention. FIG. 2A depicts a ferrite antenna according to the second embodiment. A ferrite component, such as a square ferrite bar 1, is wound around with two conductive bands, such as metal bands 7, the terminals of which are connected to the slots on board 5, as will be further described below. Metal bands 7 are coupled together by conductive patterns 8 on the upper and lower surfaces of board 5 as the coil. Thus, a two-turn ferrite antenna is formed. Conductive connection patterns 9*a* and 9*b* on the upper and lower surfaces of board 5, respectively, couple the ferrite antenna to an antenna tuning circuit (not shown).

FIG. 2B shows board 5 of FIG. 2A. A first pair of slots 6*a* and 6*b* and a second pair of slots 6*c* and 6d are located along one side of board 5. Each pair of slots is for insertion by one metal band 7 for winding around ferrite bar 1. Metal band 7 may be connected to board 5 by soldering the terminals of the metal band in a pair of slots, for example. Metal band 7 may also be connected to the pair of slots by mechanical means. Patterns 8 on the upper and lower surfaces of board 5 connect slots 6*b* and 6*c* for coupling together metal bands 7 inserted in the slots. Thus, patterns 8 form a part of the coil. Alternatively, slots 6*b* and 6*c* can be easily combined to form a large slot for connecting a terminal of a first metal band 7 to a terminal of a second metal band 7. Patterns 9*a* and 9*b* on the upper and lower surfaces of board 5, respectively, couple the ferrite antenna to the antenna tuning circuit (not shown) through slots 6*a* and 6*d*. By placing patterns 9*a* and 9*b* on different surfaces of board 5, the board space can be efficiently utilized. As is apparent, patterns 9*a* and 9*b* may be interchanged so that patterns 9*a* and 9*b* are on the lower and upper surfaces of board 5, respectively.

FIG. 2C depicts metal band 7 of FIG. 2A. Metal band 7 can be easily fabricated by bending a metal plate with a machine. Metal band 7 includes a lower terminal 7*a* and an upper terminal 7*b* for connecting the metal band to a pair of slots, such as slots 6*a* and 6*b* or slots 6*c* and 6*d*, on board 5. Each metal band is equivalent to one turn of a coil.

In the first and second embodiments described above, a fragile ferrite bar can be easily supported by metal bands 2 and 7 through the slots on the board. Furthermore, because the coil with multiple windings is connected to two or more places on the board through the slots, strong connections are achieved between the metal bands and the board. Thus, it is possible to minimize any damage to the board such as separation of the patterns from the board.

Figure 3A:
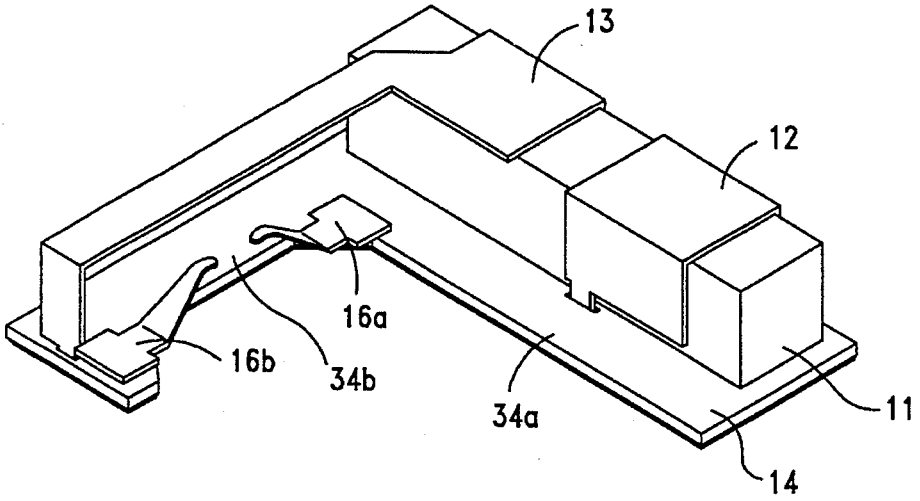
FIG. 3A illustrates a ferrite antenna according to a third embodiment of the invention.

FIGS. 3A–3D illustrate a third embodiment of the invention. FIG. 3A depicts a ferrite antenna according to the third embodiment. A ferrite component, such as a square ferrite bar 11, is mounted on an L-shaped board 14 by an adhesive. Ferrite bar 11 is wound around with two conductive bands, such as metal bands 12 and 13, the terminals of which are connected to the slots on board 14. Metal band 12 is so shaped that it is closely wound around ferrite bar 11, covering a portion of the ferrite bar on a first arm 34*a* of board 14. Metal band 13, however, is shaped so that it partially covers a portion of ferrite bar 11 on first arm 34*a* of board 14, but leaves an open area between its one end and one side surface of the ferrite bar on a second arm 34*b* of the board. Metal bands 12 and 13 are coupled together ion board 14, as will be described in detail below. Contact pins 16*a* and 16*b* on second arm 34*b* of board 14 provide a spring contact and are the input pins for connecting the ferrite antenna to an antenna tuning circuit (not shown).

Figure 3B:
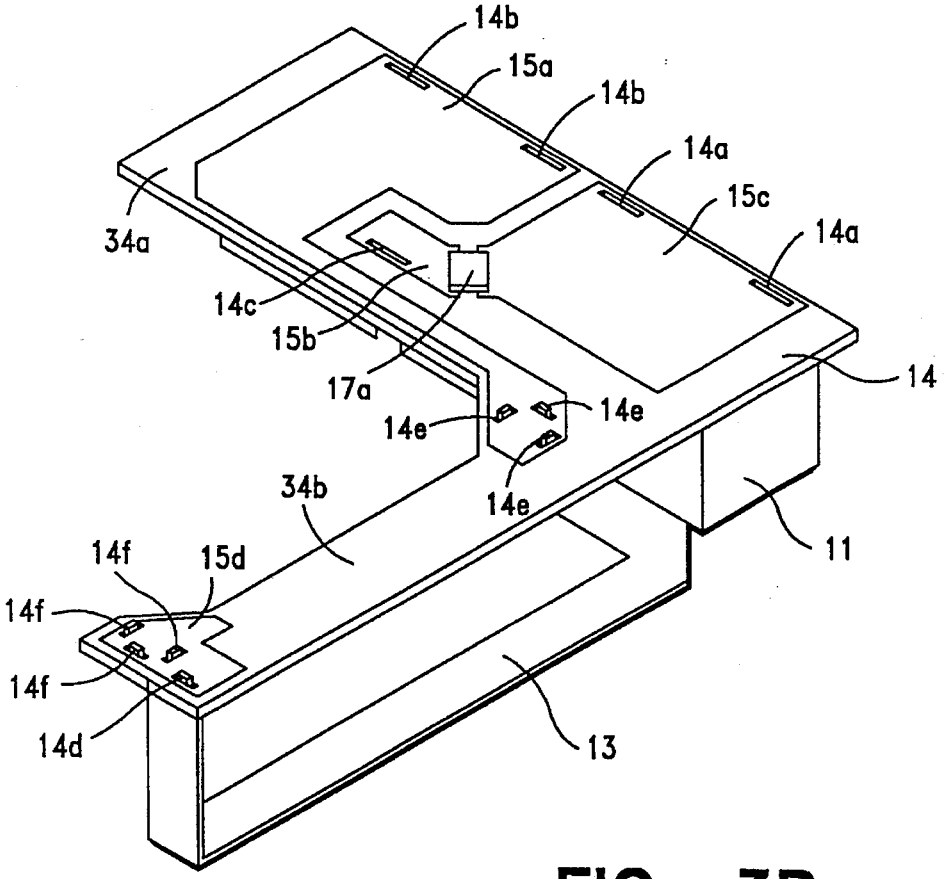
FIG. 3B illustrates the ferrite antenna in FIG. 3A viewed from the back.

FIG. 3B shows the ferrite antenna of FIG. 3A viewed from the back of board 14. Metal band 12 is connected to board 14 through slots 14*b* and 14*c*. Metal band 13 is connected to board 14 through slots 14*a* and 14*d*. Contact pin 16*a* is connected to the board through slots 14*e* and contact pin 16*b* is connected to the board through slots 14*f*. The metal bands and contact pins may be connected to board 14 by soldering their terminals in the respective slots, for example, or by mechanical means.. A conductive pattern 15*a* on the back surface of the board couples contact pin 16*a* to metal band 12 by connecting slots 14*e* to slots 14*b*. A capacitor 17*a* connects conductive patterns 15*b* and 15*c* together on the back of the board by soldering, for example. Capacitor 17*a* is for adjusting the overall inductance of the ferrite antenna. Patterns 15*b* and 15*c* couple metal band 12 to metal band 13 by connecting slots 14*c* to slots 14*a* via capacitor 17*a*. A conductive pattern 15*d* on the back of the board couples contact pin 16*b* to metal band 18 by connecting slots 14*f* to slot 14*d*. Thus, patterns 15*a* to 15*d* form a part of the coil.

Therefore, a first part of the ferrite antenna according the third embodiment of the invention is formed beginning from slot 14*e* to pattern 15*a* to slots 14*b* to metal band 12 to slot 14*c* to pattern 15*b* to capacitor 17*a* to pattern 15*c* to slots 14*a* and to a portion of metal band 13 that closely covers one side surface and the top surface of ferrite bar 11 on first arm 34*a* of board 14.

A second part of the ferrite antenna according the third embodiment of the invention is formed beginning from that portion of metal band 13 which covers the open area between one end of metal band 13 and the other side surface of ferrite bar 11 on second arm 34*b* of board 14 to slot 14*d* to pattern 15*d* to slots 14*f* to contact pin 16*b* to contact pin 16*a* via the antenna tuning circuit board and to slot 14*e*. The ferrite antenna is connected to the antenna tuning circuit board (not shown) through contact pins 16*a* and 16*b* to form a wireless device such as a FM receiver.

Figure 3C:
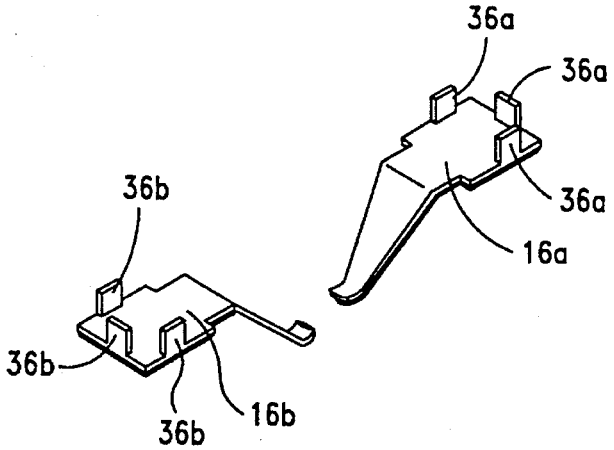
FIG. 3C depicts the contact pins in FIG. 3A.

FIG. 3C depicts contact pins 16*a* and 16*b* of FIG. 3A, which can be easily fabricated and bent with a machine. Contact pins 16*a* has three terminals 36*a* for inserting into slots 14*e* on board 14. Contact pins 16*b* has three terminals 36*b* for inserting into slots 14*f* on board 14.

Figure 3D:
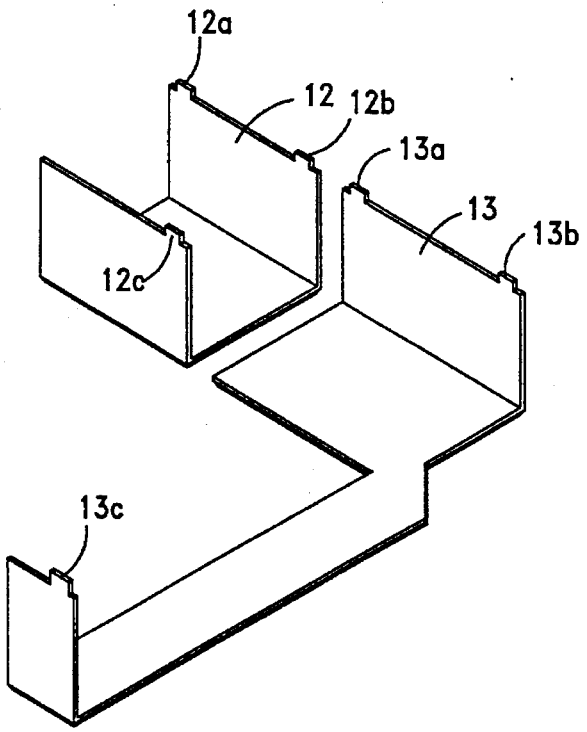
FIG. 3D depicts the metal bands in FIG. 3A.

FIG. 3D depicts metal bands 12 and 13 of FIG. 3A, which can easily be fabricated by bending metal plates with a machine. Metal band 12 has three terminals 12*a*, 12*b* and 12*c* for inserting into two slots 14*b* and one slot 14*c* on board 14, respectively. Metal band 13 has three terminals 13*a*, 13*b* and 13*c* for inserting into two slots 14*a* and one slot 14*d* on board 14, respectively.

In general, the sensitivity of wireless devices incorporating a ferrite antenna depends on the characteristics of the ferrite antenna. The characteristics of a ferrite antenna, on the other hand, are determined by the material and size of the ferrite bar used. Thus, for any given ferrite bar, there exists an upper limit to the sensitivity of the wireless device. However, by changing the shape of a metal band and by extending a part of the metal band to cover an open area on the board, the invention increases the sensitivity of the wireless device beyond the upper limit imposed by the ferrite bar used. Furthermore, the directional characteristics of the ferrite antenna become sharp and enhanced when metal bands with different shapes are arranged in same direction. When the directional characteristics are enhanced, null points occur at two directions on a one-dimensional plane which includes eight directions formed by dividing 360° by 45°. When the wireless device is operated at a null point, the noise generated by the wireless device is reduced.

Figure 5:
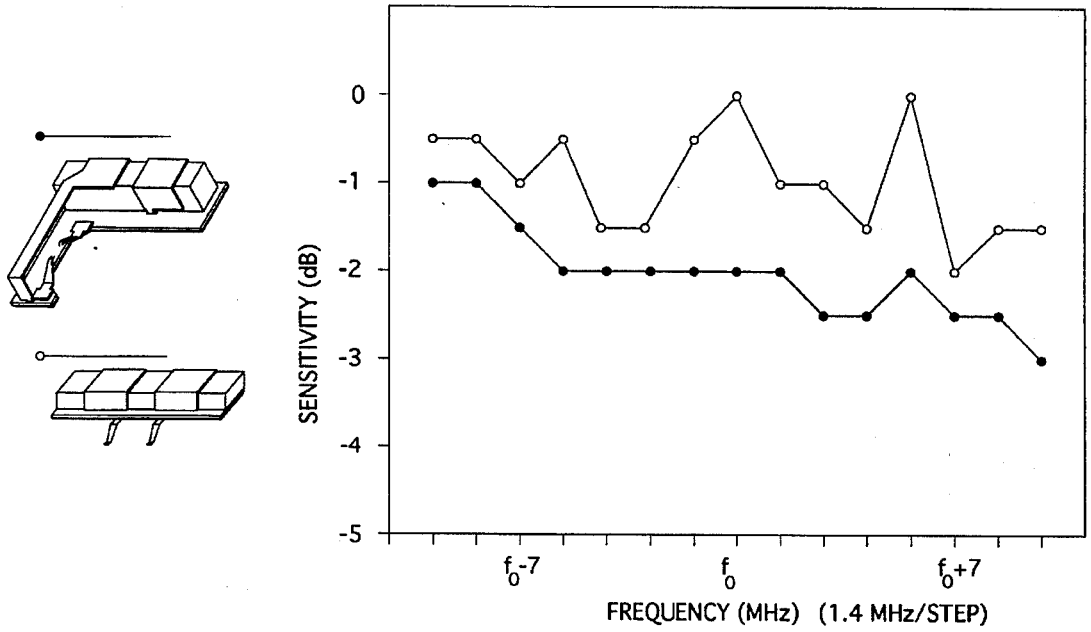
FIG. 5 compares rite frequency versus sensitivity characteristics of the ferrite antenna in FIG. 3A with those of a regular ferrite antenna that uses the same ferrite bar.
Figure 7:
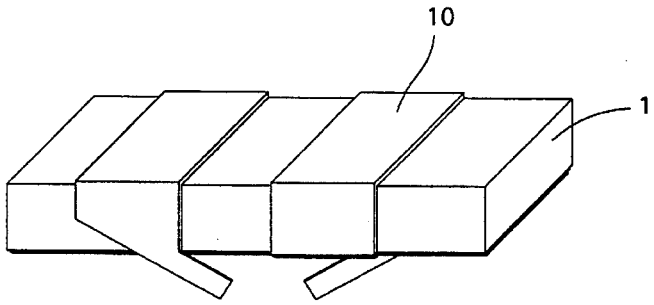
FIG.-7 PRIOR ART
FIG. 7 shows a prior art ferrite antenna.

FIG. 5A–5C compares sensitivity of the ferrite antenna shown in FIG. 3A with that of a regular ferrite antenna such as that in FIGS. 1A and 7 with a ferrite bar of the same material and size. In making the measurements in FIG. 5, high harmonic noise of 2.8 MHz is generated by a test reception circuit. The influence of the noise occurs from $f_0$–5.6 MHz to $f_0$+5.6 MHz. When the ferrite antenna is influenced by high frequency noise, deterioration in sensitivity is generated at those frequencies. As shown in FIG. 5, the reception circuit incorporating the ferrite antenna in FIG. 3A shows an improvement from 0.5 dB to 2.0 dB over that using the regular ferrite antenna. Since field strength is used for comparing sensitivity, lower values indicate better sensitivity. This improvement results from the inclusion of the second part of the antenna and the reduction in the noise emitted from the wireless device.

Figure 4A:
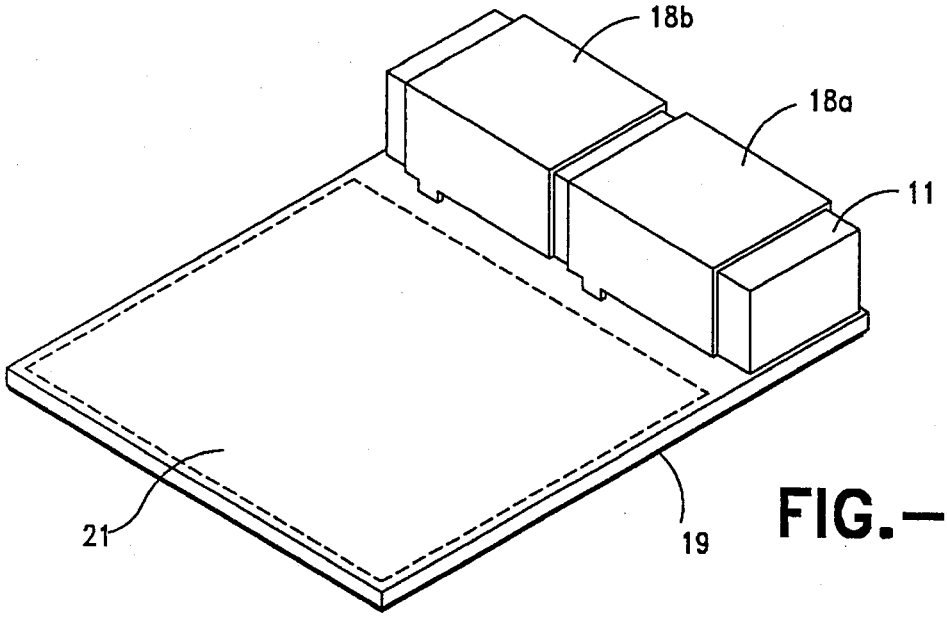
FIG. 4A illustrates an antenna according to a fourth embodiment of the invention.
Figure 4B:
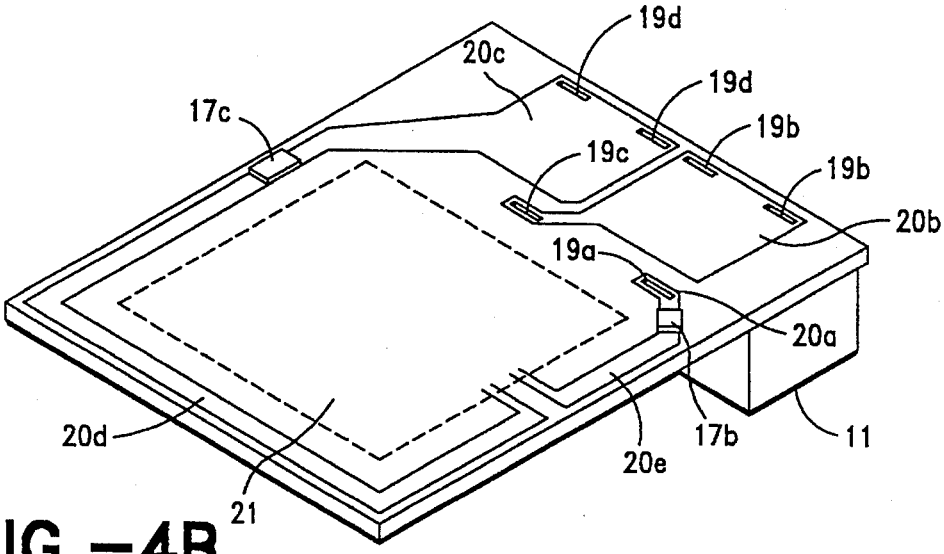
FIG. 4B illustrates the antenna in FIG. 4A viewed from the back.
Figure 4C:
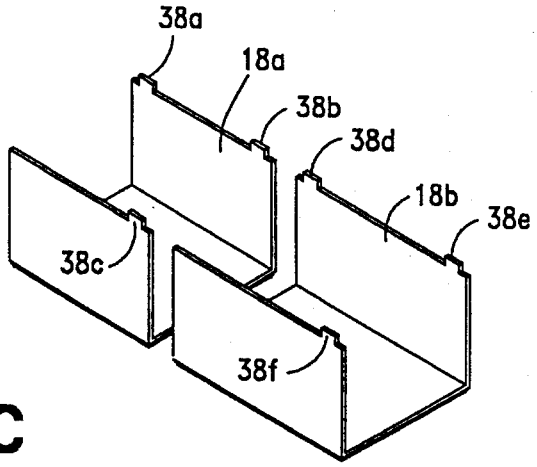
FIG. 4C depicts the metal bands in FIG. 4A.

FIGS. 4A–4C illustrate a fourth embodiment of the invention. FIG. 4A depicts an antenna according to the fourth embodiment. A ferrite component, such as a square ferrite bar 11, is mounted on a board 19 by an adhesive. Ferrite bar 11 is wound around with two conductive bands, such as metal bands 18*a* and 18*b*, the terminals of which are connected to the slots on the board. Metal bands 18*a* and 18*b* are coupled together on board 19, as will described in detail below.

FIG. 4B shows the ferrite antenna of FIG. 4A viewed from the back of board 19. Metal band 18*a* is mounted on the upper surface of board 19 through slots 19*c* and 19*d*. Metal band 18*b* is mounted on the upper surface of board 19 through slots 19*a* and 19*b*. Metal bands 18*a* and 18*b* may be connected to board 19 by soldering their terminals in the respective slots, for example, or by mechanical means. A capacitor 17*b* connects conductive patterns 20*e* and 20*a* together by soldering, for example. Patterns 20*e* and 20*a* and capacitor 17*b* couple a reception circuit 21 (not illustrated) to metal band 18*b* via slot 20*a*. Reception circuit 21 cart be mounted on either the upper or the back, or both surfaces of board 19. A conductive pattern 20*b* couples metal band 18*b* to metal band 18*a* by connecting slots 39*b* to slot 19*c*. A capacitor 17*c* connects conductive patterns 20*c* and 20*d* together by soldering, for example. Capacitors 17*b* and 17*c* are for adjusting the overall inductance of the antenna for tuning the antenna. Patterns 20*c*; and 20*d*; and capacitor 17*c* couple metal band 18*a* to reception circuit 21. The antenna is connected to reception circuit 21 to form a wireless device such as a FM receiver.

The antenna of the fourth embodiment of the invention comprises a ferrite antenna and a loop antenna. The ferrite antenna is formed from pattern 20*a* to slot 19*a* to metal band 18*b* to slot 19*b* to pattern 20*b* to slot 19*c* to metal band 18*a* to slot 19*d* to pattern 20*c* and to capacitor 17*c*. The loop antenna is formed from capacitor 17*b* to pattern 20*e* and to pattern 20*d* via reception circuit 21.

FIG. 4C depicts metal bands 18*a* and 18*b* of FIG. 4A, which can be easily fabricated by bending metal plates with a machine. Metal band 18*a* has three terminals 38*a*, 38*b* and 38*c* for inserting into two slots 19*d* and one slot 19*c*, respectively. Metal band 18*b* has three terminals 38*d*, 38*e* and 38*f* for inserting into two slots 19*b* and one slot 19*a*, respectively.

Figure 6:
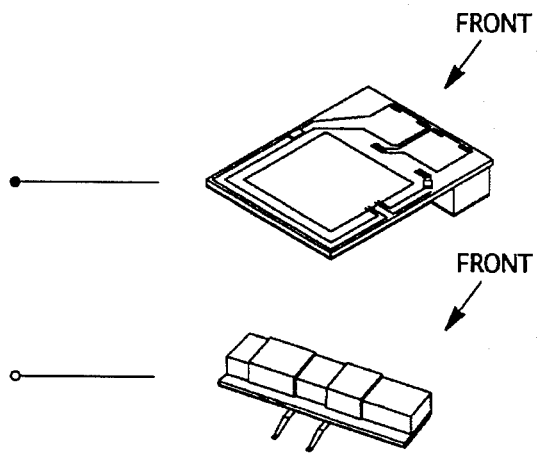
FIG. 6 compares the eight direction sensitivity characteristics of the antenna in FIG. 4A with those of a regular ferrite antenna that uses the same ferrite bar.
Figure 6:
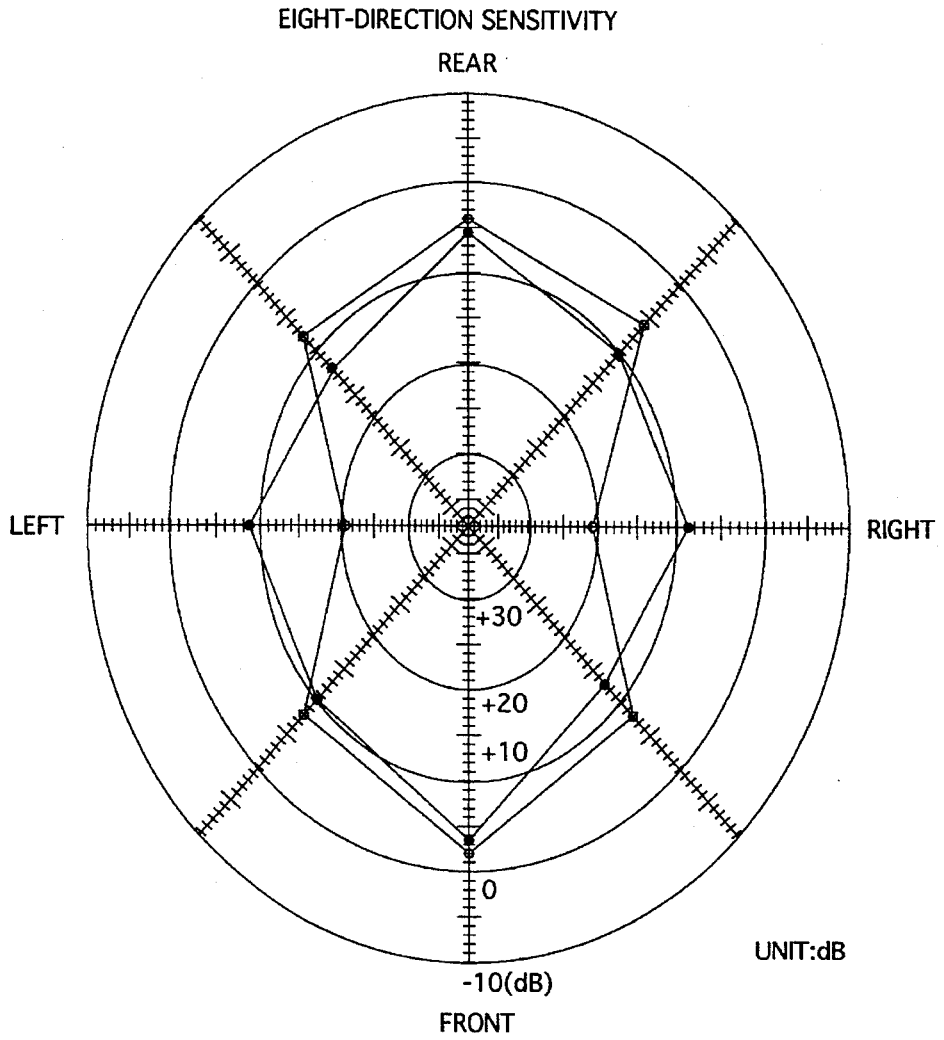

FIGS. 6 6A–6C shows a comparison of the eight direction sensitivity of the antenna in FIG. 4A with that of a regular ferrite antenna such as that in FIGS. 1A and 7 with a ferrite bar of the same material and size. The eight directions in a one-dimensional plane are formed by dividing 360° by 45° . As shown in FIG. 6, the sensitivity of the antenna in FIG. 4A is increased because of the addition of the loop antenna. The directional characteristics of the antenna are in a circular shape and the antenna has almost the same amount of sensitivity in all directions. These characteristics not only allow applications of the antenna in wireless devices that can be carried on one's person such as a radio receiver, or a pager but also applications in general portable wireless devices.

While the invention has been described in conjunction with several specific embodiments, it is evident to those skilled in the art that many further alternatives, modifications and variations will be apparent in light of the forgoing description. Thus, the invention described herein is intended to embrace all such alternatives, modifications, applications and variations as may fall within the spirit and scope of the appended claims.

What is claimed is:

1. A ferrite antenna, comprising:

a board including a conductive pattern on its surface, the pattern having first and second ends and forming part of a coil, said board further including a plurality of slots each at one of a plurality of preselected locations along two opposite sides on the board surface, the pattern extending between and coupling together two slots on the two opposite sides on the board surface;

a ferrite component having two ends and disposed on said board; and a first conductive band wound around said ferrite component and coupled to said board through two slots arranged in a first pair on the two opposite sides on the board surface, said first band having one end coupled to the first end of the pattern and forming a first turn of the coil.

2. The ferrite antenna of claim 1, further comprising a second conductive band wound around said ferrite component and coupled to said board through two slots on the two opposite sides arranged in a second pair, and wherein the pattern couples one slot in the first pair to one slot in the second pair to couple said first and second bands together to form two turns of the coil.

3. The ferrite antenna of claim 2, further comprising a plurality of conductive bands each wound around said ferrite component and coupled to two slots on the two opposite sides arranged in a pair, and wherein said board further includes a plurality of conductive patterns each coupling one slot in one pair to one slot in an adjacent pair to couple two adjacent bands together, so that a plurality of turns of the coil are formed.

4. The ferrite antenna of claim 2, wherein the first pair of slots is located side by side with the second pair of slots on said board, with each pair including two slots located opposite to each other, and wherein the pattern diagonally couples the slot in the first pair to the slot in the second pair.

5. The ferrite antenna of claim 4, wherein said first and second bands are mounted on said board through the first and second pairs of slots.

6. The ferrite antenna of claim 5, wherein the first and second bands are U-shaped metal bands.

7. A ferrite antenna, comprising:

a board;

a ferrite component having two ends and mounted on said board;

a first conductive band coupled to said board and partially enclosing said ferrite component and an open area between said ferrite component and one end of said band; and a second conductive band wound around said ferrite component and coupled to said first band;

wherein said board includes a plurality of slots for coupling said first and second bands and a first conductive pattern on its surface coupling together said first and second bands through said slots and forming part of a coil.

8. The ferrite antenna of claim 7, further comprising first and second contact pins coupled to said first and second bands, respectively, for coupling the antenna to a tuning circuit.

9. The ferrite antenna of claim 8, wherein said board further includes a second conductive pattern on its surface coupling said second band to said second contact pin and forming part of the coil.

10. The ferrite antenna of claim 9, further comprising means, coupled between the first and second patterns, for adjusting the inductance of the antenna.

11. An antenna, comprising:

a board including first and second conductive patterns which form part of a coil, the patterns being disposed on a surface around the periphery of said board for coupling to a reception circuit at a first end of each pattern;

a ferrite component having two ends and mounted on said board; and a first conductive band wound around said ferrite component and coupled to the first and second patterns at a second end of each pattern; and a second conductive band wound around said ferrite component and coupled between said first band and the second end of the second pattern;

wherein said board includes a plurality of slots through which said first and second bands are coupled.

12. The ferrite antenna of claim 11, wherein said board includes a third conductive pattern on its surface coupling together said first and second bands and forming part of the coil.

13. The antenna of claim 12, further comprising means, coupled between the first band and the first pattern and between the second band and the second pattern, for adjusting the inductance of the antenna.

14. The antenna of claim 13, wherein each band is a U-shaped metal band including a plurality of terminals at its ends for respectively coupling to slots on said board.

15. A ferrite antenna, comprising:

a board including a conductive pattern on its surface and a plurality of slots along one side on its surface, the pattern having first and second ends and extending between and coupling together two slots, the pattern forming part of a coil;

a ferrite component;

a first conductive band wound around said ferrite component and coupled to said board through two slots arranged in a first pair, said first band having one end coupled to the first end of the pattern and forming a first turn of the coil; and a second conductive band wound around said ferrite component and coupled to said board, through two slots arranged in a second pair, said second band having one end coupled to the second end of the pattern and forming a second turn of the coil.

16. The ferrite antenna of claim 15, wherein said board further includes two connection patterns for coupling the antenna to a tuning circuit through one slot in the first pair and one slot in the second pair, both of which two slots are not coupled to the conductive pattern.

17. The ferrite antenna of claim 16, wherein said first and second bands are clamped to said board along the side through the first and seconds pairs of slots, respectively.

18. The ferrite antenna of claim 17, wherein first and second bands are metal bands having a partially enclosed shape and each band has two terminals at its ends coupled to a respective pair of slots.

19. A ferrite antenna, comprising:

a curved board including first and second arms;

a ferrite component mounted on the first arm of said board; and a first conductive band coupled to said board and extending from the first arm to the second arm, said band partially enclosing said ferrite component on the first arm and an open area between said ferrite component and one end of said band on the second arm.

20. The ferrite antenna of claim 19, further comprising a second conductive band wound around said ferrite component and coupled to said first band on the first arm of said board.

21. The ferrite antenna of claim 20, further comprising first and second contact pins coupled to said first and second bands, respectively, for coupling the antenna to a tuning circuit; and wherein said board includes a conductive pattern on its surface or coupling together said first and second bands.

22. The ferrite antenna of claim 21, wherein said board further includes a second conductive pattern on its surface for coupling said second band to said second contact pin.

23. The ferrite antenna of claim 22, further comprising means, coupled between the first and second patterns, for adjusting the inductance of the antenna.

* * * * *

UNITED STATES PATENT AND TRADEMARK OFFICE

CERTIFICATE OF CORRECTION

PATENT NO. : 5,561,438

DATED : October 01, 1996

INVENTOR(S) : Toshihiko Nakazawa, et al.

It is certified that errors appear in the above identified patent and that said Letters Patent is hereby corrected as shown below:

Column 9, line 14, delete ",".

Column 9, line 26, insert --said-- after "wherein".

Column 10, line 18, change "or" to --for--.

Signed and Sealed this

Twenty-ninth Day of June, 1999

*Attest:*

*Attesting Officer*

Q. TODD DICKINSON

*Acting Commissioner of Patents and Trademarks*